United States Patent [19]

Falk et al.

[11] 4,048,813

[45] Sept. 20, 1977

[54] DETACHABLE CONTAINER REFRIGERATION SYSTEM

[75] Inventors: Henry Joseph Falk, Grand Island, N.Y.; Gerald Charles Tocci, Morrestown, N.J.

[73] Assignee: Union Carbide Corporation, New York, N.Y.

[21] Appl. No.: 586,100

[22] Filed: June 11, 1975

[51] Int. Cl.[2] ..... F25D 19/00

[52] U.S. Cl. ..... 62/297; 62/449; 62/514 R; 239/587

[58] Field of Search ..... 239/587, 588; 62/297, 62/298, 449, 514 R

[56] References Cited

U.S. PATENT DOCUMENTS

| | | | |
|---|---|---|---|
| 3,254,656 | 6/1966 | Cambell et al. | 239/587 X |
| 3,675,439 | 7/1972 | Maurer | 62/514 R X |
| 3,684,179 | 8/1972 | Fischer | 239/587 X |

*Primary Examiner*—Ronald C. Capossela
*Attorney, Agent, or Firm*—John C. LeFever

[57] ABSTRACT

A cryogenic spray dispensing assembly having a longitudinally movable fluid conduit, thrust member means and compression exerting means positioned against the fluid conduit for upward urging of the thrust member against the product container ceiling.

5 Claims, 7 Drawing Figures

DETACHABLE CONTAINER REFRIGERATION SYSTEM

BACKGROUND OF THE INVENTION

This invention relates to refrigeration apparatus for detachable joining to shipping containers and especially shipping containers refrigerated on shipboard using cold air which is introduced and removed from said containers by means of portholes provided therein.

Maurer U.S. Pat. No. 3,675,439 describes a detachable apparatus for the supplying portside refrigeration to perishable products which have reached their point of destination. The products are in the storage container to which refrigerated air has been supplied on board ship, but once unloaded at the point of destination refrigeration is supplied by spraying fluid such as liquid nitrogen or carbon dioxide from the detachable refrigeration apparatus. This apparatus includes a refrigerant storage tank, a flow control mechanism, a temperature sensing device which signals the control mechanism and associated pipings and fittings which are detachable and can be installed dock side on those shipping containers which have been equipped with a Maurer refrigerant dispensing means. The latter as described in the Maurer patent comprises a perforated conduit permanently installed in the upper portion of the shipping container and extending the full length of the container. The as described Maurer apparatus is not suited for shipping containers which are not equipped with the permanent spray refrigerant dispensing means and the cost of adding such means to existing containers represents a sizable investment.

The objects of this invention are to provide a cryogenic refrigeration apparatus for use with thermally insulated shipping containers which apparatus does not require substantial alterations and additions to existing shipping containers, attaches to the container, occupies extremely little space compared with its refrigeration capacity, is virtually maintenance free, is self-contained and capable of providing substantially uniform desired temperature within the shipping container.

SUMMARY OF THE INVENTION

This invention includes a refrigerant dispensing assembly comprising: a base section; a longitudinally movable fluid conduit joined to the base section; a refrigerant inlet conduit joined to one end of said refrigerant; conduit spray nozzle means joined to the other end of the fluid conduit; thrust member means joined to the fluid conduit for longitudinal movement; and compression exerting means positioned against the fluid conduit for urging of longitudinal movement.

The objects of this invention are accomplished by apparatus for refrigeration of stored product within a portable thermally insulated shipping container having at least one porthole therein, a porthole closure assembly for gas tightly sealing said porthole, a liquified gas refrigerant storage tank with associated flow control means, refrigerant dispensing and flow control means joined to said storage tank and said porthole closure assembly, and refrigerant spray means joined to said dispensing and flow control means through said porthole closure assembly for controllable refrigeration of said stored product. The improvement comprises: a support-refrigerant dispensing assembly joined to an inner side of said porthole closure assembly and having a base section; an upwardly extending fluid conduit joined to said base section for vertical movement; spray nozzle means joined to the fluid conduit upper end; thrust member means joined to said fluid conduit for vertical movement; compression means positioned against said fluid conduit for upward urging thereof; said base section, fluid conduit, compression means and thrust member being sized and arranged for upward urging of said thrust member against the container ceiling when said porthole closure member is attached to said container so as to seal said porthole.

DESCRIPTION OF PREFERRED EMBODIMENTS

Figure 1:
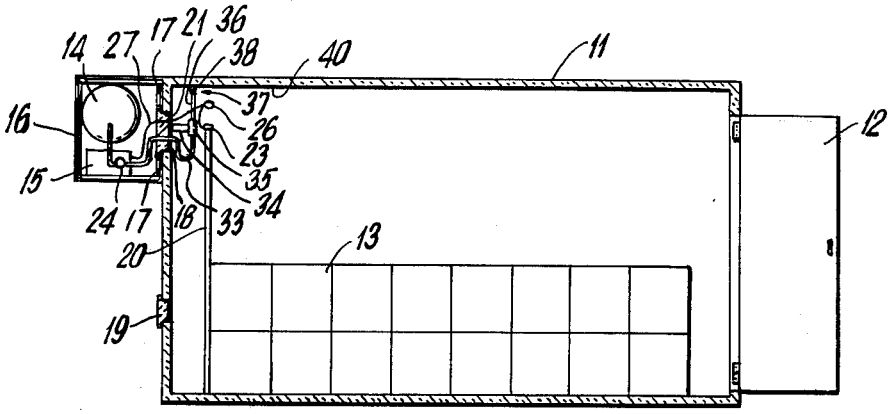
FIG. 1 is a cross-sectional elevation view of a thermally insulated container having a liquified gas refrigeration system embodiment of this invention attached to the container's upper forward portion.

FIG. 1 of this invention shows a thermally insulated shipping container 11 having access doors 12 and containing refrigerated product 13. A liquefied gas refrigerant storage tank 14 and refrigerant flow control means 15 are disposed within a clip-on assembly 16 which attaches to shipping container 11 by means of bolts 17. Shipping containers typically measure about 8 by 8 by 20 feet and the shipping containers typically preferred for use with this invention are those which have refrigerant air circulation portholes such as 18 and 19 and a retaining wall 20 behind which the contents are stored thereby creating an open space for the introduction of the refrigerated air. Porthole closure assembly 21 is mounted over porthole 18. Porthole 19 which is not necessary to this invention is shown with a plug therein.

Figure 2:
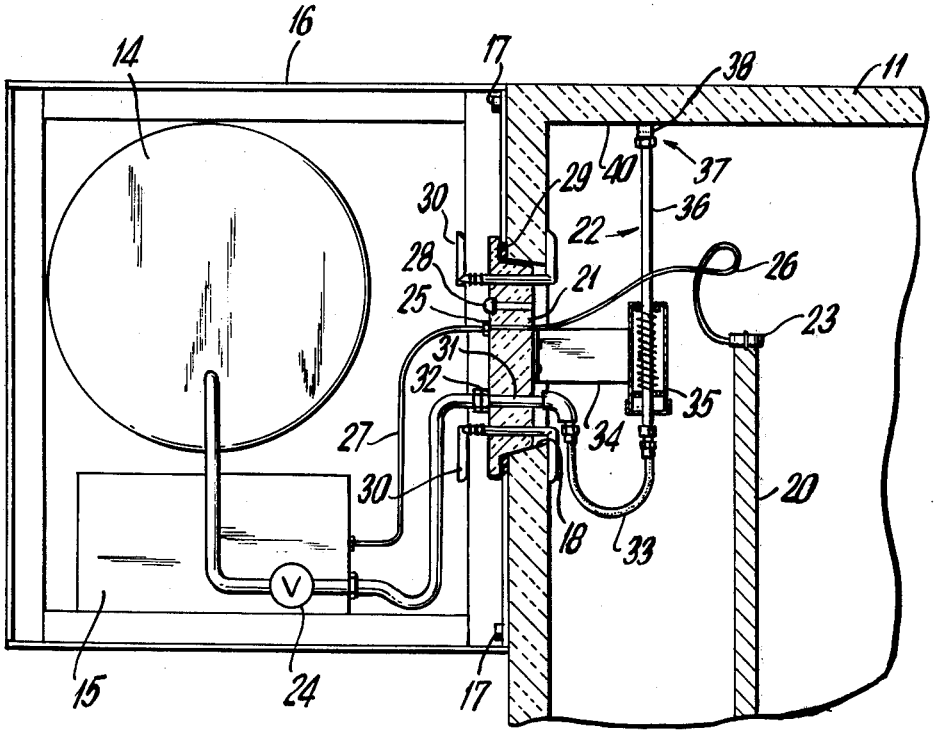
FIG. 2 is an enlarged view of the FIG. 1 liquified gas refrigeration system and attachment to the product storage container.

As shown in enlarged FIG. 2, the apparatus includes refrigerant spray means 22 joined to refrigerant dispensing and flow control means 15 through porthole closure assembly 21 for controllable refrigeration of stored product 13. Temperature sensing means 23 is positioned on retaining wall 20 by for example a clip, and is joined to temperature sensing means connector 25 in porthole closure assembly 21 by means of wire 26. Refrigerant control means 15 is detachably joined to connector 25 by flow control connector wire 27 such that refrigerant flow control is responsive to temperature sensed within container 11 by sensing means 23.

Porthole closure assembly 21 has gas pressure relief means 28 such as a mushroom-shaped rubber check valve communicating within container 11 to relieve excessive pressures generated by evaporating liquified refrigerant. Assembly 21 is arranged to detachably gas-tightly seal porthole 18 means of sealing gasket 29 and detachment locks 30. Porthole closure refrigerant conduit 31 passes through porthole closure assembly 21 and attaches at its outer end to a refrigerant connector fitting 32 which is rigidly attached to the outside of porthole closure assembly 21 and at the other end is removably attached to preferably flexible refrigerant inlet conduit 33.

Figure 3:
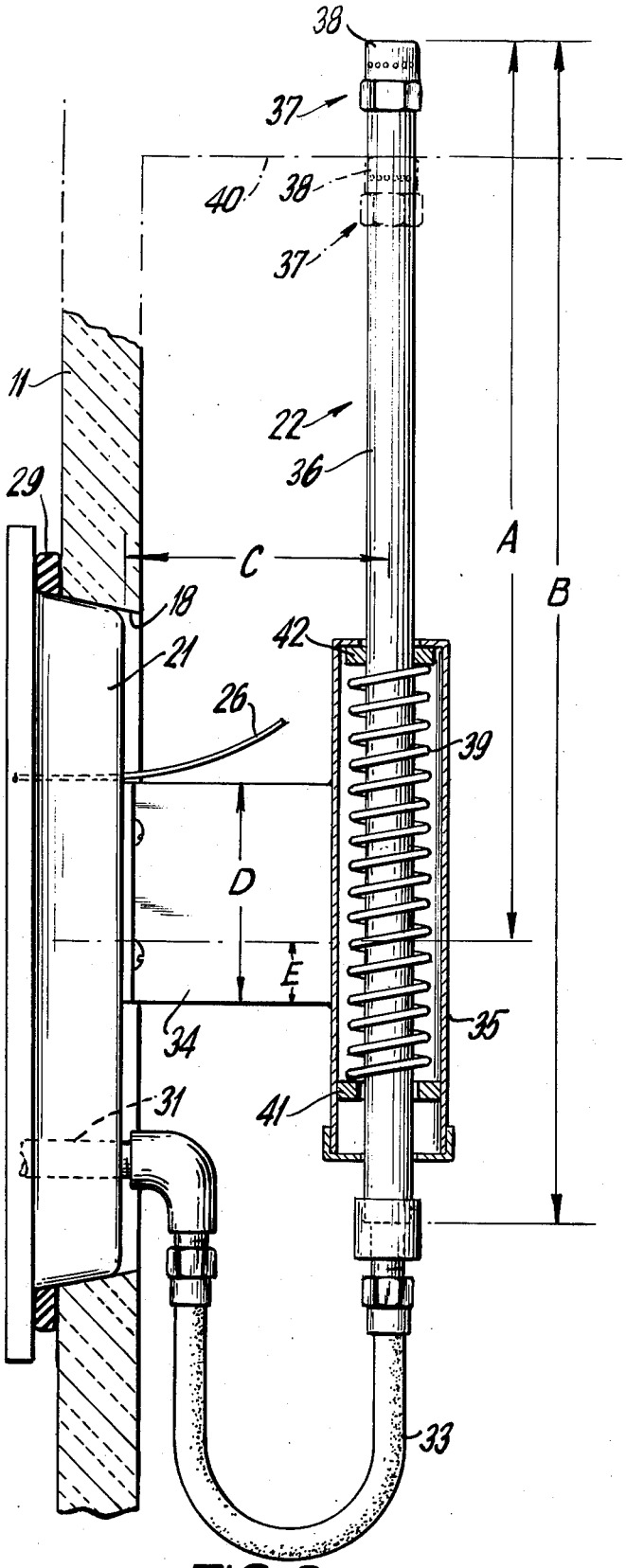
FIG. 3 is a further enlargement of the porthole closure member-support means-thrust member and compression exerting means assembly of FIGS. 1 and 2 as positioned within the product container for refrigerant dispensing.

Support-refrigerant dispensing means 34 includes a bracket joined to the inner side of porthole closure assembly 21, base section 35, an upwardly extending fluid conduit 36 joined to the base section for vertical movement, and spray nozzle means 37 joined to the fluid conduit upper end. Thrust member means 38 are joined to the top of fluid conduit 36 for vertical movement. As illustrated in FIGS. 2 and 3, the upper end of fluid conduit 36 is the aforementioned thrust member means 38, but alternatively they can be separate members as for example hereinafter described and illustrated in FIG. 4. Also as illustrated in FIGS. 2 and 3, spray nozzle means 37 is intermediate fluid conduit 36 upper end and the base section 35 but preferably near the former.

Compression exerting means 39 are positioned against fluid conduit 36 for upward urging of the latter. The base section 35, fluid conduit 36, compression means 39 and thrust member means 38 are sized and arranged for upward urging of the thrust member against ceiling 40 when porthole closure member 21 is attached to the container wall in a sealing position. In the FIGS. 2-3 embodiment, a vertically oriented cylinder comprises the base section 35 with a vertically oriented coil-type spring positioned therein as the compression exerting means 39. Opposite ends of spring 39 are positioned against lower retainer 41 and upper retainer 42 both in contact with cylinder 35 inner wall. The inner end of refrigerant inlet conduit 33 extends into cylinder 35 lower end and through lower retainer 41, the latter being longitudinal slideable against the cylinder inner wall. Alternatively, refrigerant conduit 33 inner end may join the discharge conduit 36 lower end and bypass cylinder 35. However as illustrated, the lower end of upwardly extending fluid discharge conduit 36 extends into cylinder 35 upper end and through upper retainer 42. In operation, refrigerant flows consecutively through porthole closure conduit 31, inlet conduit 33, cylinder 35, fluid discharge conduit 36 and spray nozzle means 37 for release inside container 11. In service, spring 39 causes the upper end of fluid conduit 36 (also the thrust member means 38) to bear against ceiling 40 when support means 34 is operably installed. For this installation, a workman first reaches through open porthole 18 and attaches temperature sensing means 23 to the top surface of bulkhead 20. Next, porthole closure assembly 21 complete with attached support-refrigerant dispensing assembly 34 is positioned by the workman who passes the assembly through the porthole and vertically orients fluid conduit upper end-thrust member 38 adjacent container ceiling 40. The workman then exerts sufficient upward pressure to compress spring 39 and upwardly urge fluid conduit 36 so as to horizontally align porthole closure member 21 in porthole 18 for sealing by means of gasket 29 and attachment 30.

To insure substantially uniform distribution of refrigerant through the entire length of the container, spray nozzle means 37 should be located essentially at ceiling height. This is due to the common practice of placing different sizes of product-holding boxes in stacked relation within container 11. Stack heights are commonly encountered which provide a clearance of less than 5 inches between the top of the product load and the container ceiling, and such stacking can substantially retard the longitudinal flow of refrigerant. Positioning the spray nozzle means 37 adjacent to the container ceiling mitigates this flow retarding effect.

By way of illustration, in one successful embodiment of the invention as illustrated in FIG. 3, the "A" dimension is 13½ inches, the "B" dimension is 17½ inches, the "C" dimension is 4 inches, the "D" dimension is 2½ inches, and the "E" dimension is ¾ inch.

Figure 4:
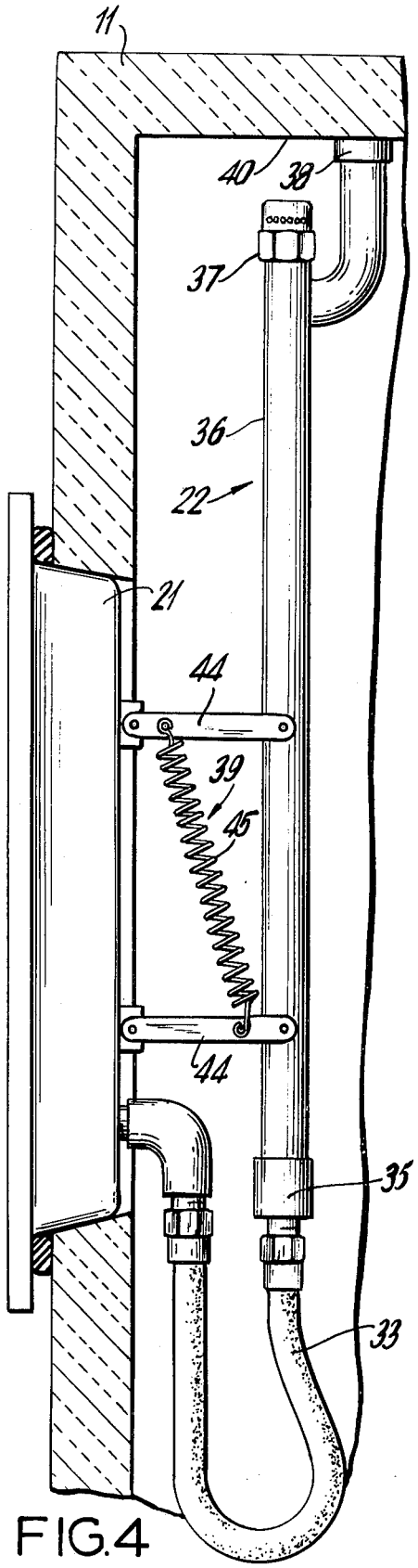
FIG. 4 is a cross-sectional elevation view of an alternative assembly for dispensing refrigerant employing a connector bar-spring assembly as the compression exerting means.

FIG. 4 illustrates an alternative refrigerant dispensing assembly 22 embodiment of the invention in which the compression means 39 comprises two pivotable bars 44 with pins at opposite ends for retention of spring 45 in a diagonal position. The spring-bar assembly in a locked position urges fluid conduit 36 upwardly toward ceiling 40 of the container. Also in this embodiment thrust member 38 bearing against ceiling 40 is separate from the upper end of spray nozzle means 37.

Figure 5:
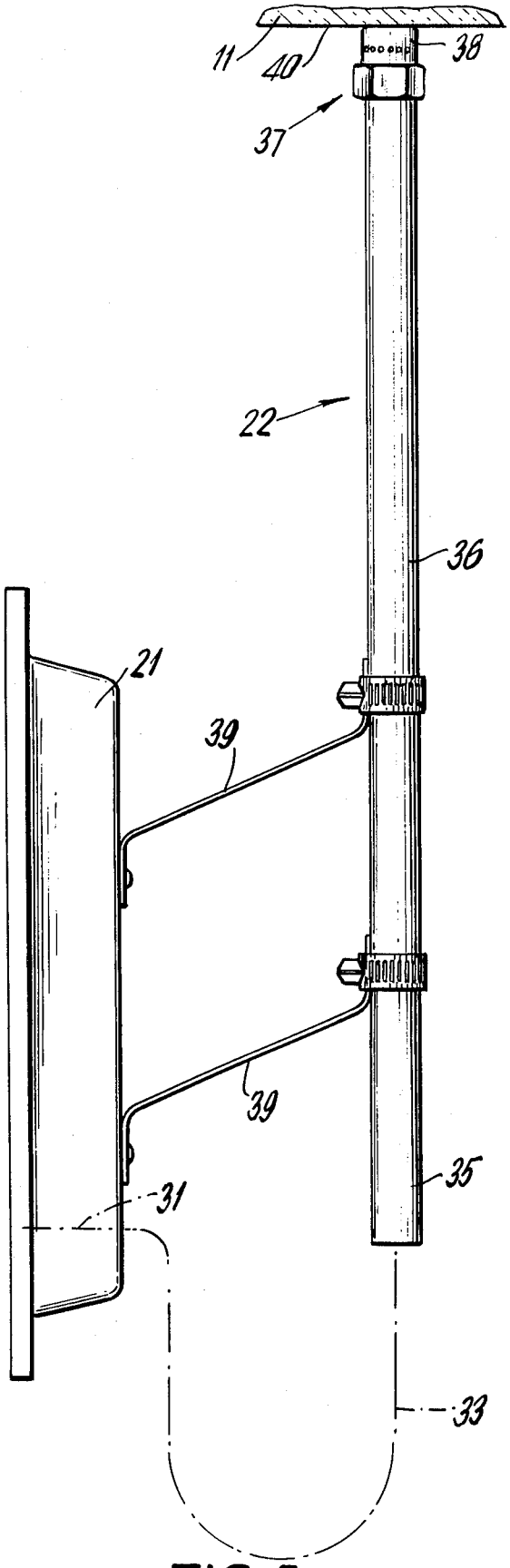
FIG. 5 is another alternative assembly employing strip springs as the compression exerting means.

FIG. 5 illustrates another alternative refrigerant dispensing assembly 22 embodiment of the invention in which compression exerting means 39 comprises two longitudinally spaced strip springs secured at one end to the inner surface of porthole closure assembly 21 and at the other end to the outer wall of upwardly extending fluid conduit 36. Also in this embodiment, base section 35 comprises the lower end of rigid fluid conduit 36. When support-refrigerant dispensing assembly 34 is transversely aligned to seal the porthole, the strip springs 39 longitudinally and upwardly urge conduit 36.

Figure 6:
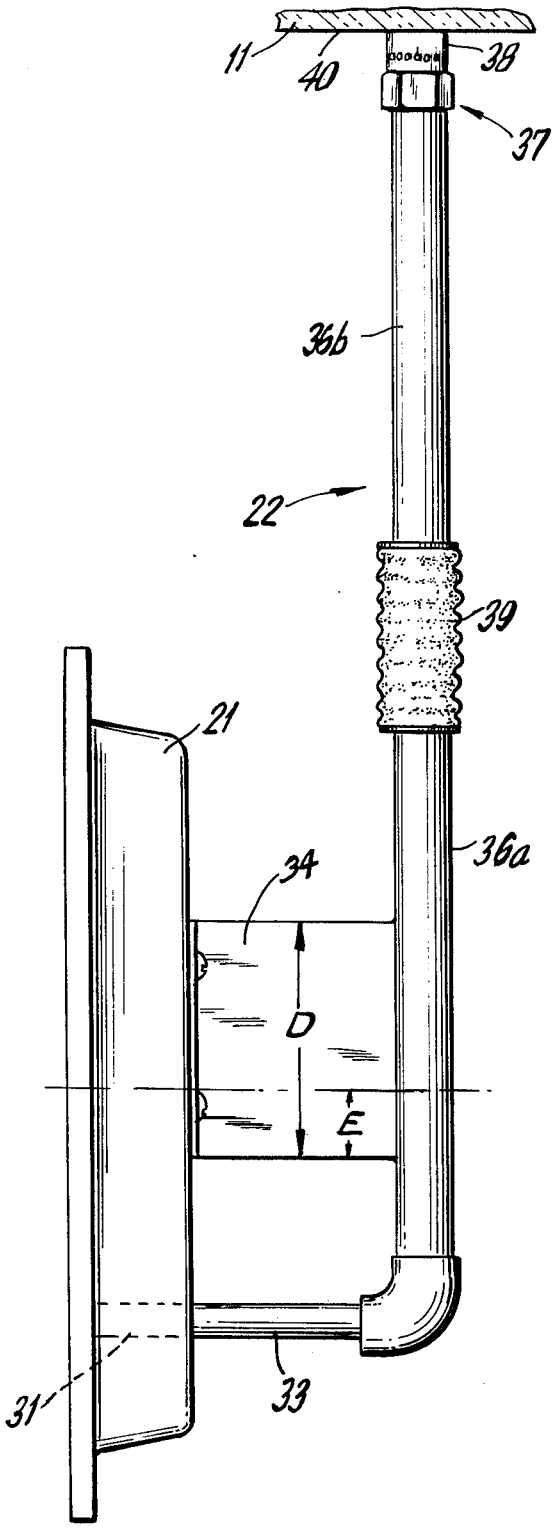
FIG. 6 is a still further alternative assembly employing bellows as the compression exerting means.

FIG. 6 is a still further alternative refrigerant dispensing assembly embodiment employing a rigid fluid discharge conduit 36 comprising lower section **36*a* and upper section 36*b*** joined by intermediately positioned and longitudinally aligned bellows as the aforementioned compression means.

In operation, responsive to signals from temperature sensing means 23 as transmitted through wire 26, refrigerant such as liquid nitrogen is dispensed from tank 14 through conduit 23 by operably connected flow control means 15. The latter is arranged to compare the sensed temperature with a predetermined desired temperature and to activate flow control valve 24 when refrigeration is required as indicated by a difference between the sensed shipping container temperature and the predetermined desired temperature.

Practice of the invention and the importance of placing the spray nozzle means adjacent to the shipping container ceiling, was demonstrated in the following tests.

TEST 1

In this test, apparatus as illustrated in FIGS. 1-3 was used to store and refrigerate a frozen meat product with sprayed nitrogen fluid. Container 10 had been held for an extended period at 0° F and contained the meat product 13 which was stacked behind retaining wall 20 to within about 10 inches of ceiling 40. The container was removed from its refrigerated environment and exposed to ambient conditions for three days during which time the ambient temperature ranged from 39° F to 86° F.

Thermocouples 1, 2 and 3 were installed in the air space between the container and the product load at the refrigerant discharge end, the midpoint and opposite end respectively, i.e. 2 feet, 10 feet and 20 feet from the porthole wall. Thermocouple 1 (adjacent a side wall of the container) indicated the air temperature at the top of the retaining wall 20. Another thermocouple positioned in the product storage container was employed as the signal for the refrigerant flow control means 15. The spray nozzle 37 was provided with six holes spaced around a 120° arc, with diameters of 0.042 inch and 0.052 inch. The centerline of the holes was 5/16 inch below the container ceiling and they were oriented to direct the spray of refrigerant fluid from the container midpoint in the transverse direction over the retaining wall and towards door 12 at the container opposite end. Thermocouples 2 and 3 were also located at the container midpoint in the transverse direction, adjacent to the ceiling 40.

Figure 7:
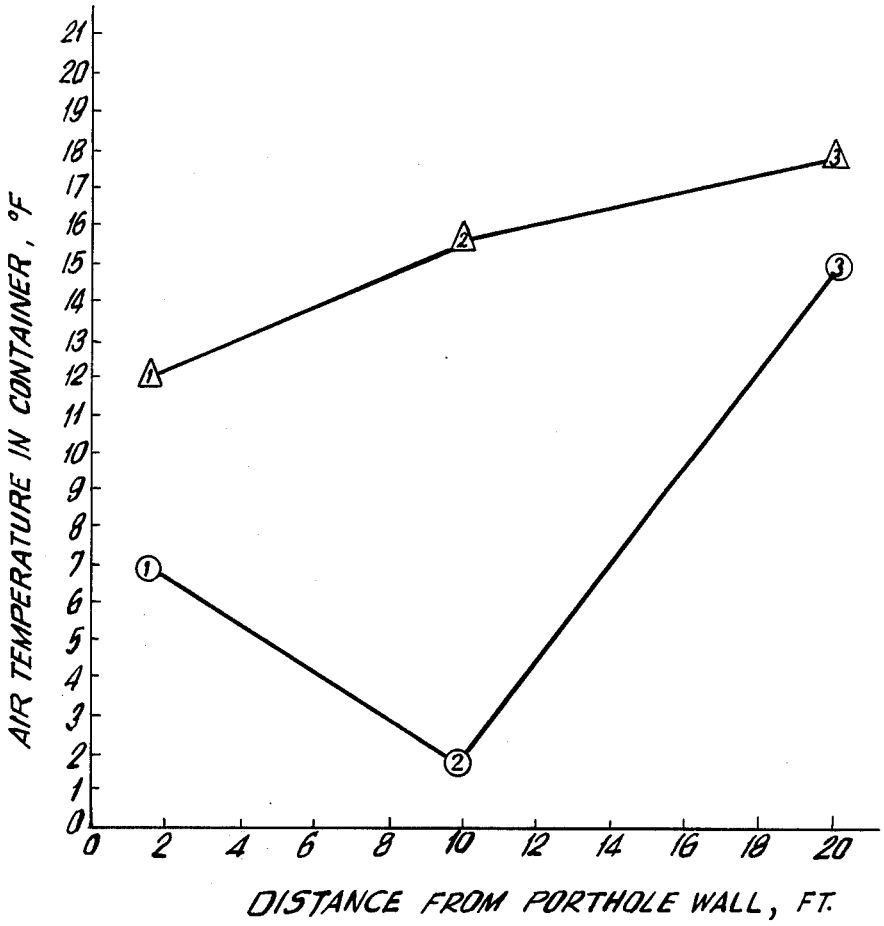
FIG. 7 is a graph showing the air temperature in a nitrogen refrigerated container as a function of the longitudinal distance from the porthole wall.

With the refrigerant flow control means based on a set point of +15° F, the temperatures of the three designated locations were monitored at eight-hour intervals and the upper curve of FIG. 7 is a plot of the temperature vs. container length on the third day of the test.

TEST 2

The Test 1 equipment was also used for this test, but spray nozzle 37 was not forced to bear against the shipping container ceiling 40 and there was an air space of about 1½ inches between the ceiling and the spray nozzle closed end. That is, the centerline of the holes was about 1¾ inch below the container ceiling. With the refrigerant flow control means based on a set point of +10° F, the temperatures of the aforementioned three designated locations were monitored at eight hour intervals and the lower curve of FIG. 7 is a plot of the temperature vs. container length on the third day of the test. Prior to this test the shipping container had been stored at ambient temperature ranging from 71° F to 94° F.

A comparison of the Test 1 and Test 2 data on FIG. 7 clearly indicate that temperature control was far superior in Test 1 with the spray nozzle located proximate to the container ceiling. A substantial variance in temperature over the container length was observed when the spray nozzle was not located near the ceiling. This of course is undesirable for several reasons, including inefficient use of refrigeration and/or inadequate cooling of a portion of the stored product.

Although preferred embodiments have been described in detail it will be appreciated that other embodiments are contemplated along with modifications of the disclosed features, as being within the scope of the invention.

What is claimed is:

1. A refrigerant dispensing assembly comprising: a base section; a longitudinally movable fluid conduit joined to said base section; a refrigerant inlet conduit joined to one end of said fluid conduit; spray nozzle means joined to the other end of said fluid conduit; thrust member means joined to said fluid conduit for longitudinal movement; and mechanical compression exerting means positioned against said fluid conduit for urging of longitudinal movement.

2. In apparatus for refrigeration of stored product within a portable thermally insulated shipping container having at least one porthole therein, a porthole closure assembly for gas tightly sealing said porthole, a liquified gas refrigerant storage tank with associated flow control means, refrigerant dispensing and flow control means joined to said storage tank and said porthole closure assembly, and refrigerant spray means joined to said dispensing and flow control means through said porthole closure assembly for controllable refrigeration of said stored product, the improvement comprising: a support-refrigerant dispensing assembly joined to the inner side of said porthole closure assembly and having a base section; an upwardly extending fluid conduit joined to said base section for vertical movement; spray nozzle means joined to the fluid conduit upper end; thrust member means joined to said fluid conduit for vertical movement; mechanical compression exerting means positioned against said fluid conduit for upward urging thereof; said base section, fluid conduit, compression means and thrust member being sized and arranged for upward urging of said thrust member against the container ceiling when said porthole closure member is attached to said container so as to seal said porthole.

3. Apparatus according to claim 2 wherein the upper end of said fluid conduit is said thrust member and said spray nozzle means is intermediate such upper end and said base section.

4. Apparatus according to claim 2 wherein a coil spring comprises said compression means.

5. Apparatus according to claim 4 wherein a vertically aligned cylindrical housing comprises said base section with said coil spring vertically positioned therein; a fluid inlet conduit section extending with the lower end of said cylindrical housing; and the lower end of said fluid conduit extends into the upper end of said cylindrical housing in abutting relationship with said coil spring.

* * * * *